US009141016B2

(12) United States Patent
Watanabe

(10) Patent No.: US 9,141,016 B2
(45) Date of Patent: Sep. 22, 2015

(54) IMAGE FORMING APPARATUS WITH POSITION CORRECTION CONTROL

(71) Applicant: CANON KABUSHIKI KAISHA, Tokyo (JP)

(72) Inventor: Shinri Watanabe, Mishima (JP)

(73) Assignee: Canon Kabushiki Kiasha, Tokyo (JP)

( * ) Notice: Subject to any disclaimer, the term of this patent is extended or adjusted under 35 U.S.C. 154(b) by 0 days.

(21) Appl. No.: 13/707,912

(22) Filed: Dec. 7, 2012

(65) Prior Publication Data

US 2013/0156472 A1 Jun. 20, 2013

(30) Foreign Application Priority Data

Dec. 9, 2011 (JP) ..... 2011-270296

(51) Int. Cl.

*G03G 15/01* (2006.01)
*G03G 13/22* (2006.01)
*G03G 15/00* (2006.01)

(52) U.S. Cl.

CPC ..... *G03G 13/22* (2013.01); *G03G 15/0189* (2013.01); *G03G 15/5058* (2013.01); *G03G 2215/0158* (2013.01)

(58) Field of Classification Search

CPC ..... G03G 13/22; G03G 15/0189; G03G 15/5058; G03G 2215/0158
USPC ..... 399/301, 49, 72, 74; 347/116
See application file for complete search history.

(56) References Cited

U.S. PATENT DOCUMENTS 2,768,827 A * 10/1956 Noble ..... 101/181
5,548,381 A 8/1996 Saito et al.
5,631,686 A * 5/1997 Castelli et al. ..... 347/133
5,678,132 A * 10/1997 Shiba et al. ..... 399/59
5,909,235 A * 6/1999 Folkins ..... 347/240
6,327,453 B1 * 12/2001 Imaizumi et al. ..... 399/301
6,456,311 B1 * 9/2002 Harush et al. ..... 347/116
6,526,237 B2 * 2/2003 Endo ..... 399/49
6,603,495 B2 8/2003 Hayakawa
6,633,737 B1 * 10/2003 Tanaka et al. ..... 399/66
7,254,350 B2 8/2007 Kawamura et al.
7,343,110 B2 3/2008 Sakamoto
7,509,065 B2 * 3/2009 Itagaki ..... 399/49

(Continued)

FOREIGN PATENT DOCUMENTS

JP 7-134479 A 5/1995
JP 2002-23445 A 1/2002

(Continued)

*Primary Examiner* — G. M. Hyder

(74) *Attorney, Agent, or Firm* — Fitzpatrick, Cella, Harper & Scinto

(57) ABSTRACT

An image forming apparatus can form a correction image for correcting a positional deviation and includes an image forming unit, an image carrying member, a light detection unit, an ambient condition detection unit, and a control unit. The image carrying member receives the correction image, which is formed by the image forming unit. The light detection unit illuminates the correction image on the image carrying member and detects light reflected thereby. The ambient condition detection unit detects, as an ambient condition, at least one of temperature and humidity in an operating condition of the image forming apparatus. The control unit effects position correction control at a time of image formation of the image forming unit on the basis of a detection result of the light detection unit and an ambient condition detected by the ambient condition detection unit.

16 Claims, 13 Drawing Sheets

(56) References Cited

U.S. PATENT DOCUMENTS

| | | | | |
|---|---|---|---|---|
| 7,660,542 | B2 * | 2/2010 | Hamahashi | 399/49 |
| 2002/0085849 | A1 * | 7/2002 | Endo | 399/49 |
| 2003/0210412 | A1 * | 11/2003 | Ishibashi | 358/1.9 |
| 2004/0052554 | A1 * | 3/2004 | Harada et al. | 399/301 |
| 2004/0057739 | A1 * | 3/2004 | Shimura | 399/49 |
| 2006/0029407 | A1 * | 2/2006 | Sakamoto | 399/44 |
| 2006/0177246 | A1 * | 8/2006 | Kawada et al. | 399/301 |
| 2006/0198648 | A1 * | 9/2006 | Itagaki | 399/49 |
| 2007/0110485 | A1 * | 5/2007 | Katsuhara et al. | 399/301 |
| 2008/0279599 | A1 * | 11/2008 | Nagatsuka | 399/301 |
| 2009/0080915 | A1 * | 3/2009 | Hashimoto | 399/39 |
| 2010/0080603 | A1 * | 4/2010 | Takahashi | 399/72 |
| 2010/0172662 | A1 * | 7/2010 | Ogawa | 399/39 |
| 2013/0164047 | A1 * | 6/2013 | Kakutani et al. | 399/301 |

FOREIGN PATENT DOCUMENTS

| | | | |
|---|---|---|---|
| JP | 3427278 | B2 | 7/2003 |
| JP | 2003-241470 | A | 8/2003 |
| JP | 2005-18094 | A | 1/2005 |
| JP | 2005-234238 | A | 9/2005 |
| JP | 2006-47605 | A | 2/2006 |
| JP | 2007-272111 | A | 10/2007 |
| JP | 2009-93155 | A | 4/2009 |
| JP | 2010-91953 | A | 4/2010 |

* cited by examiner

| | BLK CORRECTION PDe_ky [dot] | MGN CORRECTION PDe_my [dot] | CYN CORRECTION PDe_cy [dot] |
|---|---|---|---|
| SECTION A | 0.5 | 0.1 | 0.2 |
| SECTION B | 0.6 | 0.2 | 0.3 |
| SECTION C | 0.7 | 0.3 | 0.4 |

Fig. 1

| | BLK CORRECTION PDe_ky [dot] | MGN CORRECTION PDe_my [dot] | CYN CORRECTION PDe_cy [dot] |
|---|---|---|---|
| SECTION A | 0.5 | 0.1 | 0.2 |
| SECTION B | 0.6 | 0.2 | 0.3 |
| SECTION C | 0.7 | 0.3 | 0.4 |

IMAGE FORMING APPARATUS WITH POSITION CORRECTION CONTROL

FIELD OF THE INVENTION AND RELATED ART

The present invention primarily relates to an image forming apparatus which uses an electrophotographic process. In particular, it relates to a method for controlling an electrophotographic image forming apparatus so that when images, different in color, formed on the image bearing members of the apparatus are transferred onto the intermediary transferring member of the apparatus, or directly onto a sheet of final recording medium such as a sheet of recording paper, the images will precisely align among themselves.

A color image forming apparatus equipped with multiple photosensitive drums is designed so that images, different in color, formed on its photosensitive drums, one for one, do not fail to align among themselves as they are transferred onto the subsequent image bearing means. In reality, however, when the images, different in color, formed on the photosensitive drums are transferred onto the subsequent image bearing means, the images tend to fail to precisely align among themselves, because of mechanical errors, such as the one that occurs when the photosensitive drums are attached to the frame of the image forming apparatus, the error in the length of the path of the laser beam for writing each of the electrostatic latent images for forming the multiple monochromatic developer images, different in color, one for one, the changes which occur to the laser beam paths, etc. Thus, various methods for minimizing a color image forming apparatus in the amount by which misalignment occurs among the multiple monochromatic color images when the images are transferred onto the subsequent image bearing member.

One such method is disclosed in Japanese Laid-open Patent Application 2002-023445. According to this patent application, images for minimizing a color image forming apparatus in the amount by which multiple images, different in color, fail to align among themselves as they are transferred onto an intermediary transfer belt, is formed on the intermediary transfer belt. Then, the positioning of the images for minimizing the image forming apparatus in the amount of misalignment among the multiple images, different in color, on the intermediary transfer belt, is detected in order to minimizing the image forming apparatus in the amount of the misalignment, or making the image forming apparatus virtually free of the misalignment.

Japanese Laid-open Patent Application 2002-023445 discloses a method for detecting the amount of the positional deviation of each of the multiple monochromatic toner images different in color, from a referential positional deviation detection image, by detecting the light which is regularly reflected by the positional deviation detection image. In the case of this patent application, the means for detecting the positional deviation detection image is made up of a light emitting element, such as an infrared light emitting diode, and a light sensing element, such as a photo-transistor, for catching the light regularly reflected by the positional deviation detection image. The positional deviation detection image is such an image that is made of two sections having two referential sections of a specific color, and another section which is different in color from the referential sections and is sandwiched between the two referential sections. The amount of the positional deviation among the two referential sections and the other section is calculated based on the amount of positional deviation between the center of the two referential sections and the center of the other section. Then, the image forming apparatus is adjusted in image formation settings such as the timing with which developer (toner) images, different in color, begin to be written, image formation clock, and/or the like, based on the calculated amount of the positional deviation among the two referential sections of the positional deviation detection image, and another section of the positional deviation detection image, in order to correct the apparatus in terms of the positional deviation among the multiple images, different in color, which the apparatus forms to yield a multicolor image.

Japanese Laid-open Patent Application 2009-93155 discloses another method for detecting the amount of the positional deviation among the multiple developer (toner) images, which an electrophotographic image forming apparatus forms to yield a multicolor image. According to this patent application, positional deviation detection images are formed on the intermediary transfer member of the apparatus, and the amount of the light which is diffusely reflected by the positional deviation detection images on the intermediary transfer belt is detected by the light sensing element of the sensor unit for detecting the positional deviation detection images, because the amount by which light is diffusely reflected by the intermediary transfer belt is not affected by the surface condition of the belt as much as the amount by which light is regularly reflected by the intermediary transfer belt. More specifically, in a case where the amount of the positional deviation among the positional deviation detection images is obtained by detecting the amount by which light is diffusely reflected by the positional deviation detection images, the amount by which light is diffusely reflected by a black developer image (image formed of black developer) formed on the intermediary transfer belt is as small as the amount by which light is diffusely reflected by the intermediary transfer belt itself. Therefore, the positional deviation detection images are formed as shown in FIG. 14. That is, the positional deviation detection image of black color is formed on each of the three positional deviation detection images which are different in color from the black positional deviation detection images. More concretely, yellow, magenta and cyan developer images 1401, 1402 and 1403, respectively, are formed on the intermediary transfer belt, and three black developer images are formed on the yellow, magenta and cyan developer images 1401, 1402 and 1403, one for one. Thus, even the black developer image, which is very small in the amount by which it diffusely reflects light, can be detected.

Further, Japanese Laid-open Patent Applications 2007-272111 and 2005-234238 describe so-called "trailing edge piling", which is a phenomenon that when an electrostatic image on the peripheral surface of a photosensitive member (drum) is developed during an electrophotographic image forming process, developer (toner) unintendedly piles along the trailing edge portion of an exposed area of the peripheral surface of a photosensitive member (drum). To describe how and why the "trailing edge piling" occurs with reference to FIG. 15, when an electrostatic latent image on a photosensitive drum is developed by a development roller 1502, the developer (toner) particles 1504 on the peripheral surface of the electrophotographic drum 1502, which are facing the area of the peripheral surface of the photosensitive drum 1501, which is between the exposed area 1503 and unexposed area 1505, and the area adjacent thereto, jump onto the exposed area 1503 of the peripheral surface of the photosensitive drum 1501, which is lower in electrical potential. That is, the upstream edge portion of the exposed area of the photosensitive drum 1501 in terms of the rotational direction of the photosensitive drum 1501 receives developer (toner) by an amount greater than the theoretically correct amount. In other words, the developer (toner) piles up across the trailing edge portion of the exposed area of the peripheral surface of the photosensitive drum 1501 as shown (1601) in FIG. 16. Thus, in order to minimize an electrophotographic image forming apparatus in "trailing edge piling", that is, in the amount by which developer (toner) piles up along the trailing edge of the exposed portion of the peripheral surface of the photosensitive drum 1501, the fourth of the abovementioned four patent applications proposes the following method. That is, the method extracts the information about the contour of the image to be formed, from the information about the image to be formed. Then, it modifies (adjusts) the original image formation data in such a manner that the trailing edge portion of the image to be formed, will be theoretically less in image density.

Japanese Laid-open Patent Application H7-134479 describes the relationship between the ambient temperature of an image forming apparatus and the extent of the "trailing edge piling". More specifically, when an electrophotographic image forming apparatus is operated in an environment which is low in temperature and humidity, the tribo-electric charge which the developer (toner) acquires is relatively narrow in terms of the range, and therefore, the "trailing edge piling" is small in the amount. However, there is such a tendency that as the environment in which an electrophotographic image forming apparatus is being operated increases in temperature and humidity, the level to which the developer (toner) becomes triboelectrically charged becomes wider in range in proportion to the amount by which temperature and humidity increase.

When an electrophotographic image forming apparatus is operated in an environment in which the "trailing edge piling" occurs, the "trailing edge piling" occurs to the positional deviation detection images while they are formed on the photosensitive drums to be transferred onto the intermediary transfer member. In a case where the position of the edge of the positional deviation detection images, along which developer (toner) has piled is detected by a sensor, it cannot be accurately detected, which is problematic in that the detected position of the trailing edge of the positional deviation detection image is incorrect.

For example, in a case where a sensor structured to detect the amount of the positional deviation of an image, by detecting the amount of the light diffusely reflected by the surface of the image, a positional deviation detection image is formed as shown in FIG. 17(A). That is, first, a referential developer image 1701, that is, a positional deviation detection image of yellow color (referential color) is formed, and a black developer image 1702, that is, the image, the position of which is detected, formed on the referential (yellow) developer image 1701. In this case, the trailing edge of the resultant positional deviation detection image is excessive in the amount of developer, being therefore higher in density than the theoretically correct amount, because of the effect of the "trail edge piling", as shown in FIG. 17(B). Thus, the analog signal outputted by the sensor, which shows the intensity (amount) of the light diffusely reflected by the positional deviation detection image, becomes as shown in FIG. 17(C). More specifically, the analog signal related to the referential developer image, or the color (yellow) image, has the pattern represented by a solid line 1706, being slightly higher in amplitude at the trailing edge. As for the analog signal related to the black developer image, the black developer image absorbs light, being therefore small in the amount (intensity) by which it diffusely reflect light. Therefore, the analog signal from the sensor, which shows the amount by which light is diffusely reflected by the black developer, is hardly effected by the "trail end piling", even thought the "trailing edge piling" occurs to the black developer image.

The amount of positional deviation of the positional deviation detection image is calculated as follows. The analog signal outputted by the sensor is digitized with reference to a preset threshold value. Then, the amount of positional deviation of the positional deviation detection image is calculated based on a point in time at which the thus obtained digital signal steps up and a point in time at which the digital signal steps down. More concretely, referring to FIG. 17(D), the position of the center of the background color developer image (pattern) 1701 is obtained (calculated) based on a point ty11 in time at which the digital signal steps up in value and a point ty12 in time at which the digital signal steps down in value. Similarly, the position of the center of the black developer image is obtained by calculation based on a point tk11 in time at which the digital signal steps down, and a point tk12 in time at which the digital signal steps up. Then, a distance $\Delta dy$ between the position of the center of the background color image and the position of the center of the black developer image is calculated as the amount of positional deviation of the trailing edge of the background color image.

When the "trailing edge piling" does not occur, the analog signal outputted by the sensor, and the digital signal obtained from the analog signal with the use of a preset threshold value, become as indicated by a broken line 1705 in FIG. 17(C) and a broken line in 17(D), respectively. Therefore, when there is no positional deviation between the background color image and black developer image, the amount $\Delta dy$ of the positional deviation is zero ($\Delta dy=0$) as shown in FIG. 17(E). However, when the "trailing edge piling" occurs, the tailing edge portion of the background developer image becomes higher in density. Therefore, the analog signal outputted by the sensor, and the digital signal obtained from the analog signal with the use of a preset threshold value, become as indicated by a solid line 1706 in FIG. 17(C) and a solid line in 17(D), respectively. Therefore, even when there is no positional deviation between the background color image (pattern) and black developer pattern, the amount $\Delta dy$ of the positional deviation is not zero ($\Delta dy' \neq 0$) as shown in FIG. 17(E). That is, the position of the trailing edge of the background image is detected as if it has deviated in position.

As the "trailing edge piling" occurs, the amount of the positional deviation among the positional deviation detection images formed on the intermediary transfer belt cannot be accurately detected. Thus, it is impossible to precisely correct an electrophotographic image forming apparatus in the positional deviation among the positional deviation detection images, based on the results of the detection of the images by the sensor.

SUMMARY OF THE INVENTION

The present invention was made in consideration of the above-described issue. Thus, the primary object of the present invention is to provide a technology for precisely correcting an electrophotographic image forming apparatus which uses multiple developers, different in color, to form a multicolor image, in the positional deviation among the multiple monochromatic images formed on the multiple image bearing members of the apparatus, one for one.

These and other objects, features, and advantages of the present invention will become more apparent upon consideration of the following description of the preferred embodiments of the present invention, taken in conjunction with the accompanying drawings.

BRIEF DESCRIPTION OF THE DRAWINGS

FIG. 1 is an example of a table which shows the relationship between the temperature/humidity range (having three sub-ranges), and the amounts PDe_ky, PDe_my and PDe_cy, by which the position of the trailing edge of the positional deviation detection images of black, magenta, and cyan colors, respectively, are to be corrected.

DESCRIPTION OF THE PREFERRED EMBODIMENTS

Hereinafter, the embodiments of the present invention are described with reference to the appended drawings. The following embodiments of the present invention are examples of the embodiment of the present invention. They are not intended to limit the present invention in scope.

(Embodiment 1)

Next, the first embodiment of the present invention is described.

[Description of Image Forming Apparatus]

Figure 2:
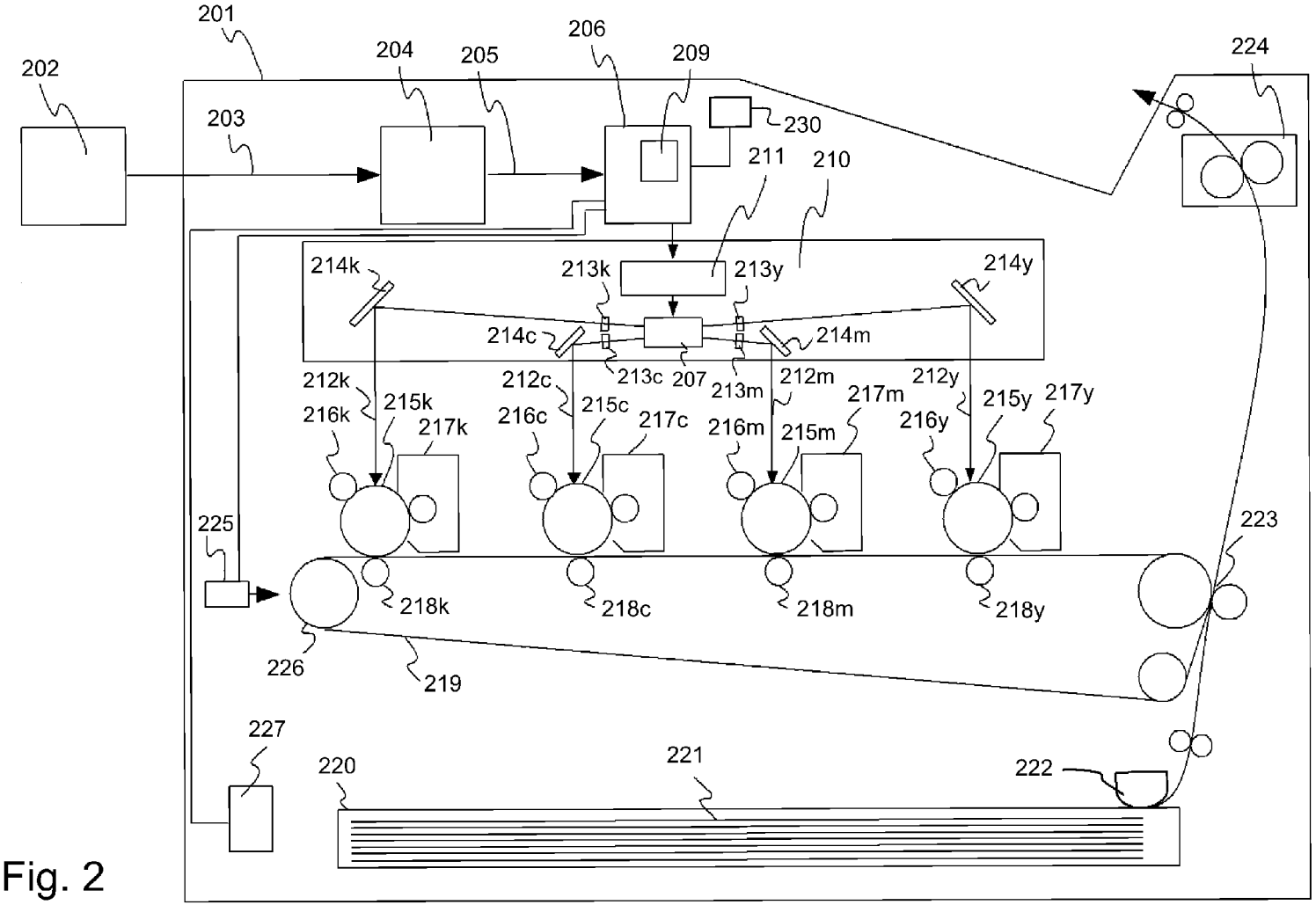
FIG. 2 is a schematic sectional view of the image forming apparatus in the first and second embodiments of the present invention, and shows the positioning of the various components of the apparatus, which are related to the present invention.

FIG. 2 is a schematic sectional view of the image forming apparatus 201, more specifically, a color laser beam printer. It shows the structure of the apparatus. The image forming apparatus in this embodiment is capable of forming a multicolor image by layering two or more of yellow (Y), magenta (M), cyan (C) and black (Bk) images. Thus, it has four image forming stations, different in the color of the image they form.

The image forming operation of the color laser beam printer 201 is as follows. As the printer 201 receives image formation data 203 from a host computer 202, it converts the image data 203 into video signal data with the use of its printable image generating section 204, and generates video signals for forming the image to be formed. The control section 206 of the printer 201 has a computing means such as a CPU 209. As the CPU 209 receives the video signal 205 generated by the printable image generating section 204, it drives multiple laser diodes 211, as laser light emitting elements, which are in the scanner units 210, in response to the video signal 205.

The beams 212*y*, 212*m*, 212*c* and 212*k* of laser light (which hereafter will be referred to as laser beam 212) emitted by the laser diodes 211, one for one, are deflected by a polygonal mirror 207, are transmitted through lenses 213*y*, 213*m*, 213*c* and 213*k* (which hereafter will be referred to as lens 213), are deflected by deflection mirrors 214*y*, 214*m*, 214*c* and 214*k* (which hereafter will be referred to as deflection mirror 214), so that they are projected upon the peripheral surface of the photosensitive drums 215*y*, 215*m*, 215*c* and 215*k* (which will be referred to as photosensitive drum 215), respectively. The photosensitive drums 215*y*, 215*m*, 215*c* and 215*k*, which are image bearing members, are charged by charging means 216*y*, 216*m*, 216*c* and 216*k* (which hereafter will be referred to as charging means 216), respectively.

As the laser beam 212 is projected upon the charged area of the peripheral surface of the photosensitive drum 215, the points of the charged area of the peripheral surface of the photosensitive drum 215, upon which the laser beam 212 was projected, reduce in surface potential level. Consequently, an electrostatic latent image is effected on the peripheral surface of the photosensitive drum 215. This electrostatic latent image is developed by one of developing means 217*y*, 217*m*, 217*c* and 217*k* (which hereafter will be referred to as developing means 217) into visible image formed of toner (developer), which reflects the electrostatic latent image. That is, the image forming apparatus 201 has image forming means which form four toner images, different in color, on its four photosensitive drums 215, one for one. The toner image formed on the photosensitive drum 215 is transferred (primary transfer) onto an intermediary transfer belt 219, by a proper amount of bias voltage applied to primary transfer members 218*y*, 218*m*, 218*c* and 218*k* (which hereafter will be referred to as primary transfer member 218). The intermediary transfer belt 219 is an intermediary transfer member, and is in the form of an endless belt which is circularly movable.

To describe in more detail the primary transfer of a toner image, first, the yellow toner image is transferred onto the intermediary transfer belt 219, and then, the magenta, cyan and black toner images are sequentially transferred in layers onto the yellow toner image on the intermediary transfer belt 219. Consequently, a multicolor image is effected on the intermediary transfer belt 219. As described above, the image forming apparatus 201 has also a transferring means which sequentially transfers the toner images formed on the photosensitive drums 215, one for one, onto the intermediary transfer member.

The intermediary transfer belt 219 is circularly moved by an intermediary transfer belt driving roller 226 which is under the control of the control sections 206. The sheets 221 of recording medium stored in layers in a cassette 220 are picked up one by one by a sheet feeding roller 222, and are conveyed to a secondary transfer roller 223 in synchronism with the arrival of the images having transferred onto the intermediary transfer belt 219 at the second transfer roller 223. Then, the images on the intermediary transfer belt 219 are transferred together (secondary transfer) onto the sheet 221 of recording medium by the secondary transfer roller 223. During the secondary transfer, a proper bias voltage is applied to the secondary transfer roller 223 to increase the efficiency with which the images are transferred.

After the secondary transfer of the toner images onto the sheet 221 of recording medium, the toner images are thermally fixed to the sheet 221 by the heat and pressure in a fixing device 224. Then, the sheet 221 is discharged into a delivery tray which is an integral part of the top wall of the external shell of the image forming apparatus. Designated by a referential code 225 in FIG. 2 is a sensor unit 225 for detecting the trailing edge of each of the positional deviation detection images, different in color, transferred onto the intermediary transfer belt 219. The sensor unit 225 detects the amount of the beam of light projected upon each of the positional deviation detection images, different in color, formed on the intermediary transfer belt 219, and reflected by each positional deviation detection image. Then, it sends the results of its detection to the control section 206. The control section 206 determines the position of each of positional deviation detection images (formed of developer) on the intermediary transfer belt 219, based on the results of detection of the positional deviation detection images by the sensor unit 225, and corrects the image forming apparatus in terms of the positional deviation among the multiple images, different in color, formed to yield a multicolor image, based on the determined position of each image.

An environment detection sensor 227 has a temperature detection element and a humidity detection element, such as a thermistor. It is an environment detecting means which detects the temperature and humidity (which will be referred to as temperature/humidity, hereafter) of the environment in which the image forming apparatus 201 is being operated. It sends the detected temperature and humidity to the control section 206. The environment detection sensor 227 is positioned in the image forming apparatus 201, more specifically, in an area where it is unlikely to be affected by the heat generated within the image forming apparatus 201 and also, where it can accurately detect the temperature and humidity of the environment in which the image forming apparatus 201 is being operated.

The control section 206 adjusts the parameters for controlling pressure, fixation process, positional deviation correction process, etc., based on the temperature/humidity detected by the environment sensor 227. In this embodiment, the environment sensor 227 is positioned in an internal area of the image forming apparatus 201, in which the sensor 227 can accurately detect the temperature/humidity of the environment in which the apparatus 201 is being operated. However, the environment sensor 227 may be positioned in an internal area of the apparatus 201 so that it can accurately detect the temperature/humidity of a specific point in the apparatus 201.

[Structure of Sensor Unit]

Figure 3:
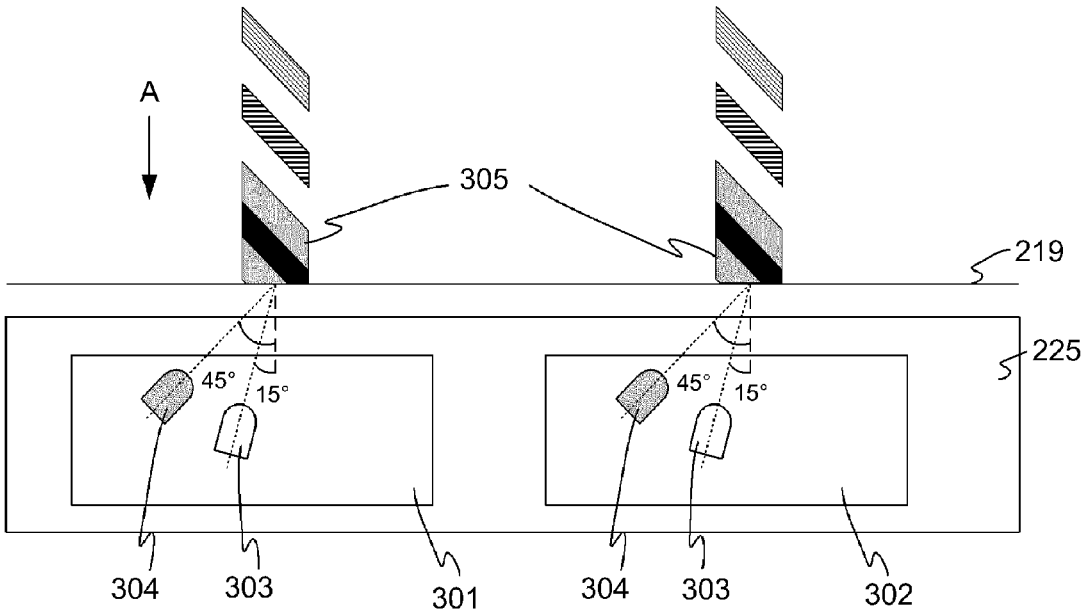
FIG. 3 is a schematic drawing of the sensor units in the first and second embodiments, and shows the structure of the units.

FIG. 3 shows the structure of the sensor unit 225. The sensor unit 225 has a pair of optical sensors 301 and 302, which are aligned in the direction perpendicular to the direction A in which the intermediary transfer belt 219 is moved, in order to detect the amount of image magnification in the primary scan direction, and the image angle relative to the secondary scan direction. The optical sensors 301 and 302 detect the amount by which a beam of light is diffusely reflected by the intermediary transfer belt 219 and each positional deviation detection image on the intermediary transfer belt 219. Each of the optical sensors 301 and 302 has a light emitting element 303 and a light sensing element 304. The light emitting element 303 is positioned so that the beam of infrared light emitted by the element 303 hits the surface of the intermediary transfer belt 219 at an angle of 15° relative to a line perpendicular to the surface of the intermediary transfer belt 219.

The light sensing element 304 which is for detecting the portion of the beam of infrared light emitted by the light emitting element 303 and diffusely reflected by the surface of the intermediary transfer belt 219 and the positional deviation detection images 305 on the intermediary transfer belt 219. It is positioned so that the angle between the line which connects the center of the light sensing element 304 and the point on the intermediary transfer belt 219 which the beam of infrared light emitted by the light emitting element 303 hits, and the line perpendicular to the surface of the intermediary transfer belt 219 becomes 45°. As the intermediary transfer belt 219 is circularly moved, the beam of infrared light emitted by the light emitting element 303 hits the surface of the intermediary transfer belt 219 and each of the positional deviation detection image 305, different in color, on the intermediary transfer belt 219, and the light sensing element 304 catches a portion of the beam of infrared light emitted by the light emitting element 303 and diffusely reflected by the surface of the intermediary transfer belt 219 and each of the positional deviation detection image 305 on the intermediary transfer belt 219.

Figure 4:
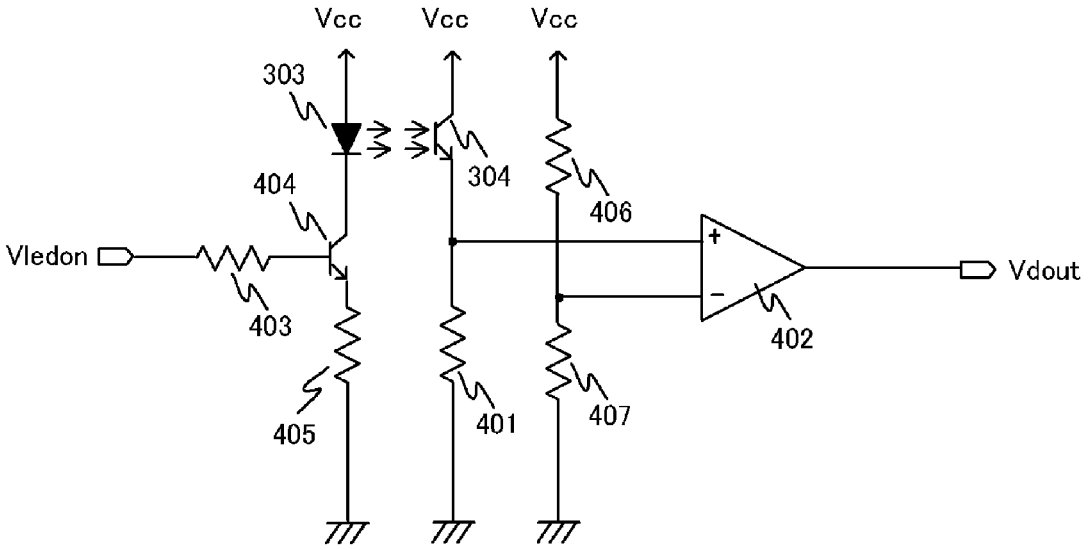
FIG. 4 is a drawing of the circuit for detecting the amount of light reflected by the positional deviation detection image, in the first and second embodiments.

FIG. 4 shows the circuit for driving the sensor unit 225. The light emitting element 303 is turned on and off by the light emitting element driving signal Vledon from the control section 206. More specifically, a switching element 404 such as a transistor is driven by the light emitting element driving signal Vledon through a base resistor 405, whereby the current which flows to the light emitting element 303 is controlled by a current regulator resistor 405, turning on or off the light emitting element 303. As the light sensing element 304 receives the portion of the beam of infrared light emitted by the light emitting element 303 and diffusely reflected by the surface of the intermediary transfer belt 219 and each positional deviation image on the intermediary transfer belt 219, electric current flows through the resistor 401 by an amount proportional to the amount of light received by the light sensing element 304. Thus, the amount of the diffusely reflected light received by the light sensing element 303 is outputted in the form of an analog signal.

The above-described analog signal which shows the amount of the diffusely reflected light is converted into a digital signal Vdout, by comparing the analog signal in voltage with a preset threshold voltage, the value of which is set by a pair of voltage dividing resistors 406 and 407. The control section 206 detects the points in time at which the digital signal steps up in value (voltage) and the points in time at which the digital signal steps down in value (voltage) by sampling the digital signal Vout with preset intervals, and sequentially stores the points in time at which each edge was detected, in an unshown storage device.

[Positional Deviation Detection Images]

Described next are a set of positional deviation detection images in this embodiment, an example of the pattern in which the positional deviation detection images are arranged, and a method for correcting the image forming apparatus 201 in the positional deviation which occurs among multiple developer images (toner images) different in color as the images are transferred onto the intermediary transfer belt 219.

Figure 5:
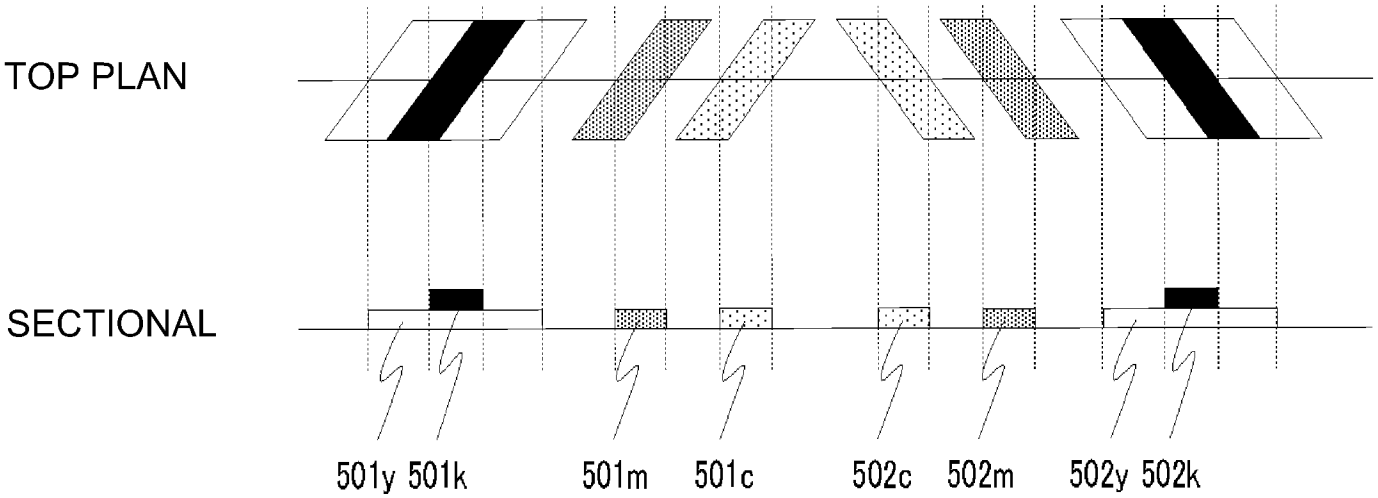
FIG. 5 is a drawing of the positional deviation detection images, in the first and second embodiments.

FIG. 5 shows a set of positional deviation detection images, and the pattern in which the images are arranged. FIG. 5 does not show the trailing edge buildup of developer (toner). The positional deviation detection image set is made up of yellow developer images 501*y* and 502*y*, magenta developer images 501*m* and 502*m*, cyan developer images 501*c* and 502*c*, and black developer images 501*k* and 502*k*. As is evident from FIG. 5, the positional deviation detection image set has a front half, which includes images 501*y*, 501*m*, 501*c* and 501*k*, and a rear half, which includes images 502*y*, 502*m*, 502*c* and 502*k*. The front and rear halves are symmetrical with reference to the line which coincides with the center of the set, in terms of the moving direction of the intermediary transfer belt 219 and is perpendicular to the moving direction of the intermediary transfer belt 219.

The amount of positional deviation of this positional deviation detection set can be determined by detecting the amount of positional deviation of each developer image in the set, in terms of both the primary and secondary scan directions, by the sensor unit 225. It should be noted here that the black developer image is layered upon the yellow developer image, because the light sensing element 304 of the sensor unit 225 used in this embodiment is such a light sensing element that senses the portion of the beam of light emitted from the light emitting element 303 and diffusely reflected by the positional deviation detection images.

The light which was diffusely reflected by the black developer image on the intermediary transfer belt 219 is as low in intensity as the light which was diffusely reflected by the intermediary transfer belt 219 itself. Thus, if the black developer image is formed directly on the intermediary transfer belt 219, the difference in intensity between the light which was diffusely reflected by the black developer image and the light which was diffusely reflected by the intermediary transfer belt 219 itself is too small for the sensor unit 225 to detect the edge (pattern) of the black developer image. Therefore, the black developer image, which is small in the amount by which it diffusely reflect light, is formed on the color developer image which is larger in the amount by which it diffusely reflect light, so that the edge of the black developer image can be detected by the sensor unit 225. It does not need to be the yellow developer image that the black developer image is to be formed. That is, it may be the cyan developer image or magenta developer images.

Figure 6:
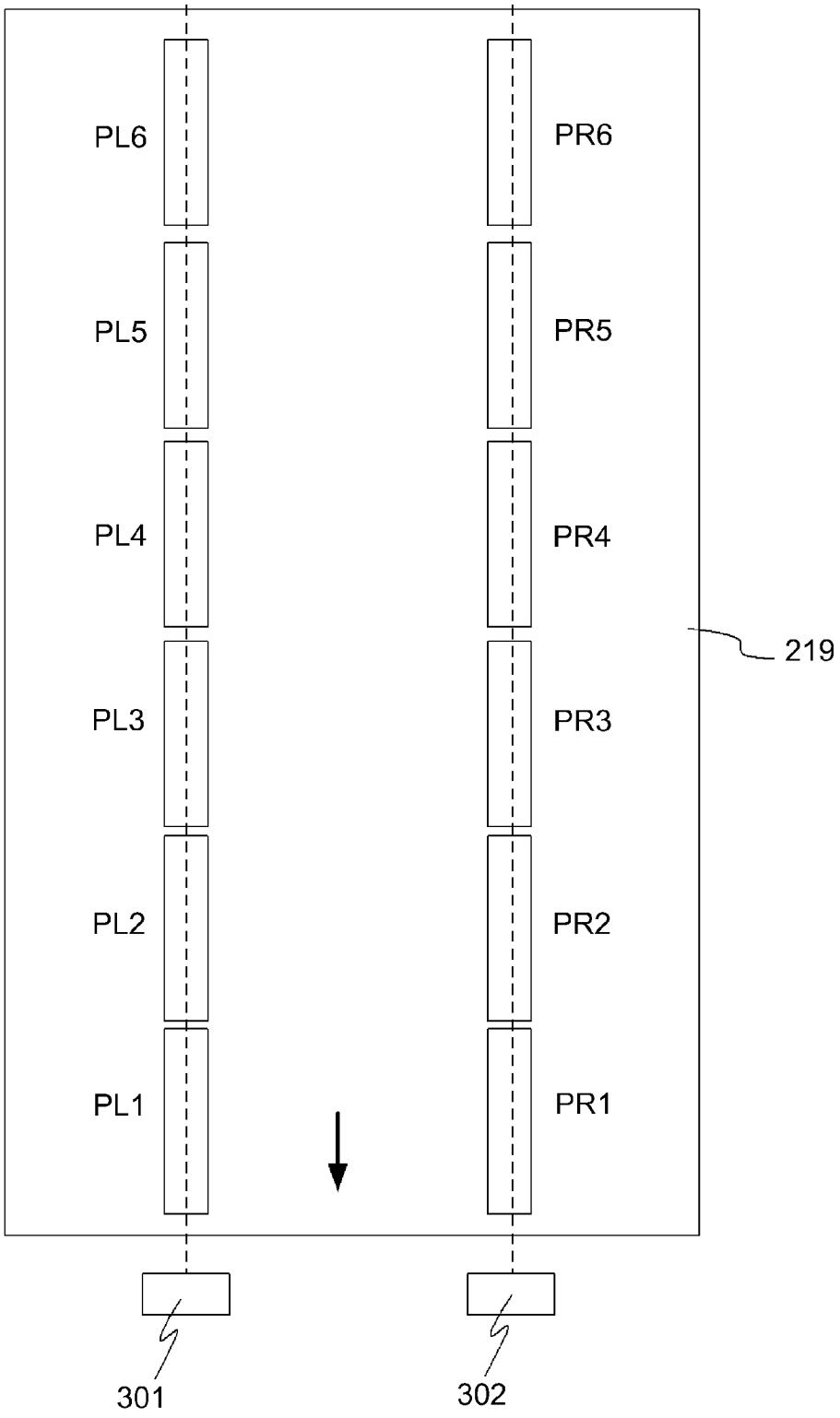
FIG. 6 is a drawing which shows the pattern in which the positional deviation detection images are arranged in the first and second embodiments.

FIG. 6 is a drawing which shows the pattern in which the positional deviation detection images are formed on the intermediary transfer belt 219. In FIG. 6, the intermediary transfer belt 219 which is an endless belt is drawn as if it were an ordinary long belt. The positional deviation detection images PL1-PL6, and PR1-PR6, in FIG. 6 correspond to the positional deviation detection images of the positional deviation detection image set in FIG. 5, respectively. In the case of FIG. 6, a set of six positional deviation detection images (PL1-PL6), which are to be detected by the optical sensor 301, and another set of six positional deviation detection images (PR1-PR6), which are to be detected by the optical sensor 302, are formed on the intermediary transfer belt 219, being evenly spaced across the entire circumference of the intermediary transfer belt 219. That is, a total of 12 positional deviation detection images are formed on the intermediary transfer belt 219. Thus, the fluctuation in the peripheral velocity, fluctuation in the moving speed of the intermediary transfer belt 219, and the like, are cancelled. As the intermediary transfer belt 219 is moved in the direction indicated by an arrow mark in FIG. 6, the positional deviation detection images on the intermediary transfer belt 219 are sequentially detected by the optical sensors 301 and 302.

Figure 7:
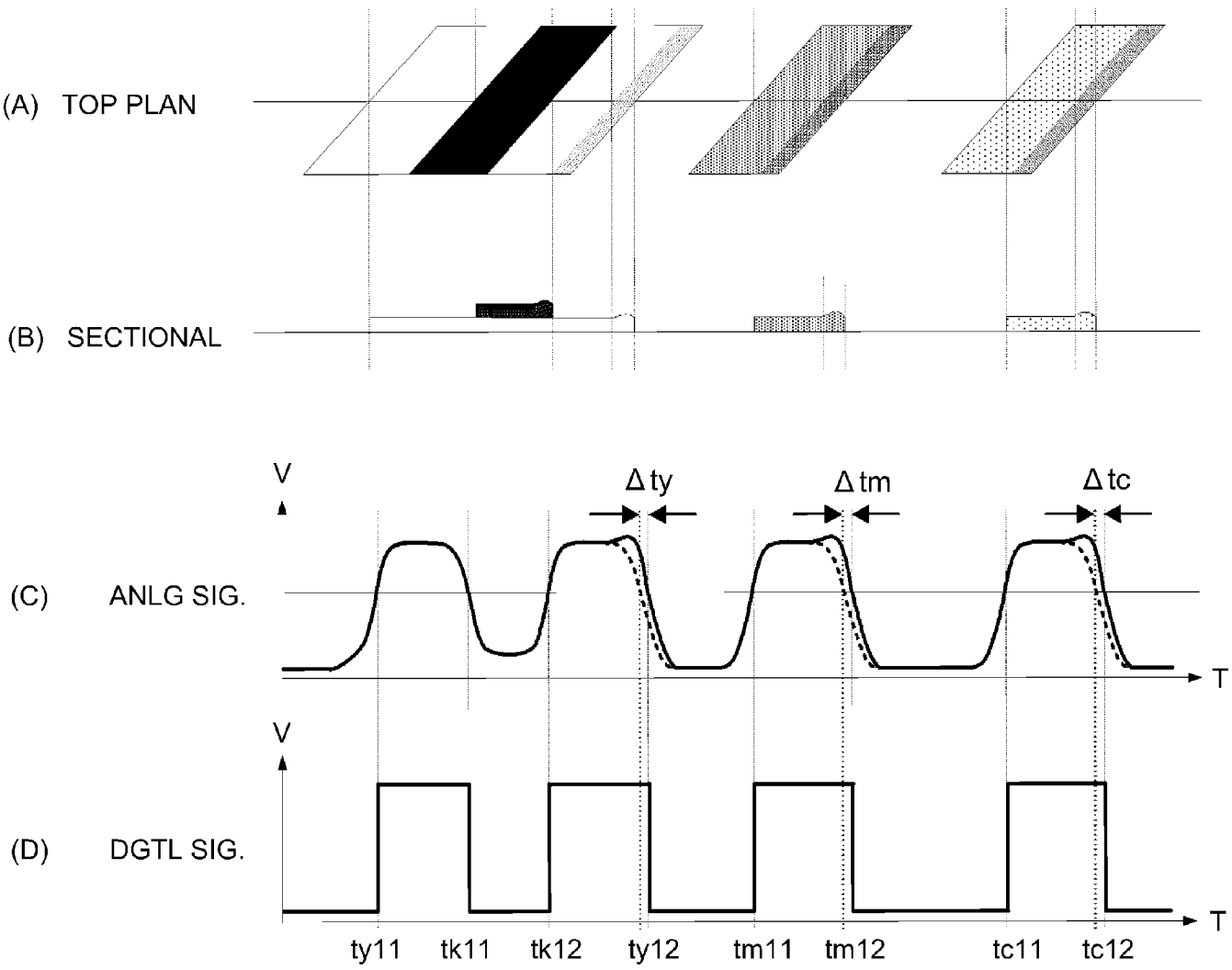
FIG. 7 is a drawing which shows the pattern in which the positional deviation detection images are arranged, and the signals outputted by the sensor for detecting the tailing edge of each of the positional deviation detection images, in the first and second embodiments.

FIG. 7(C) shows an example of waveform of the analog signal outputted by the sensor unit 225 when the positional deviation detection images were detected by the sensor unit 225. The analog signal outputted by the sensor unit 225 when the unit 225 detects the color development images in the positional deviation detection image set includes a large amount of light diffusely reflected by the color development images. Thus, its peak voltage is greater in value than the threshold voltage. On the other hand, the analog signals outputted by the sensor unit 225 when the unit 225 detects the black developer image and the intermediary transfer belt 219 itself do not include a large amount of components diffusely reflected by the black developer image and intermediary transfer belt 219 itself. Therefore, the portions of signals which correspond to the black developer image and intermediary transfer belt 219 itself, are lower in amplitude than the threshold voltage.

FIG. 7(D) shows an example of the waveform of the digital signal obtained by digitizing the analog signal outputted by the sensor unit 225, based on the relationship between the peak and valley portions of the analog signal and the threshold voltage, with the use of a comparator or the like device. The position of the edge of each of the color developer images, and that of the black developer image, can be detected based on this digital signal.

[Description of Method for Detecting Positional Deviation]

Next, the method for calculating the amount of positional deviation among the images for detecting the positional deviation, based on the results of the detection of the position of the edge of each positional deviation detection image, is described. The computation for determining the amount of positional deviation with the use of the following mathematical equations is carried out by the control section 206.

Figure 8:
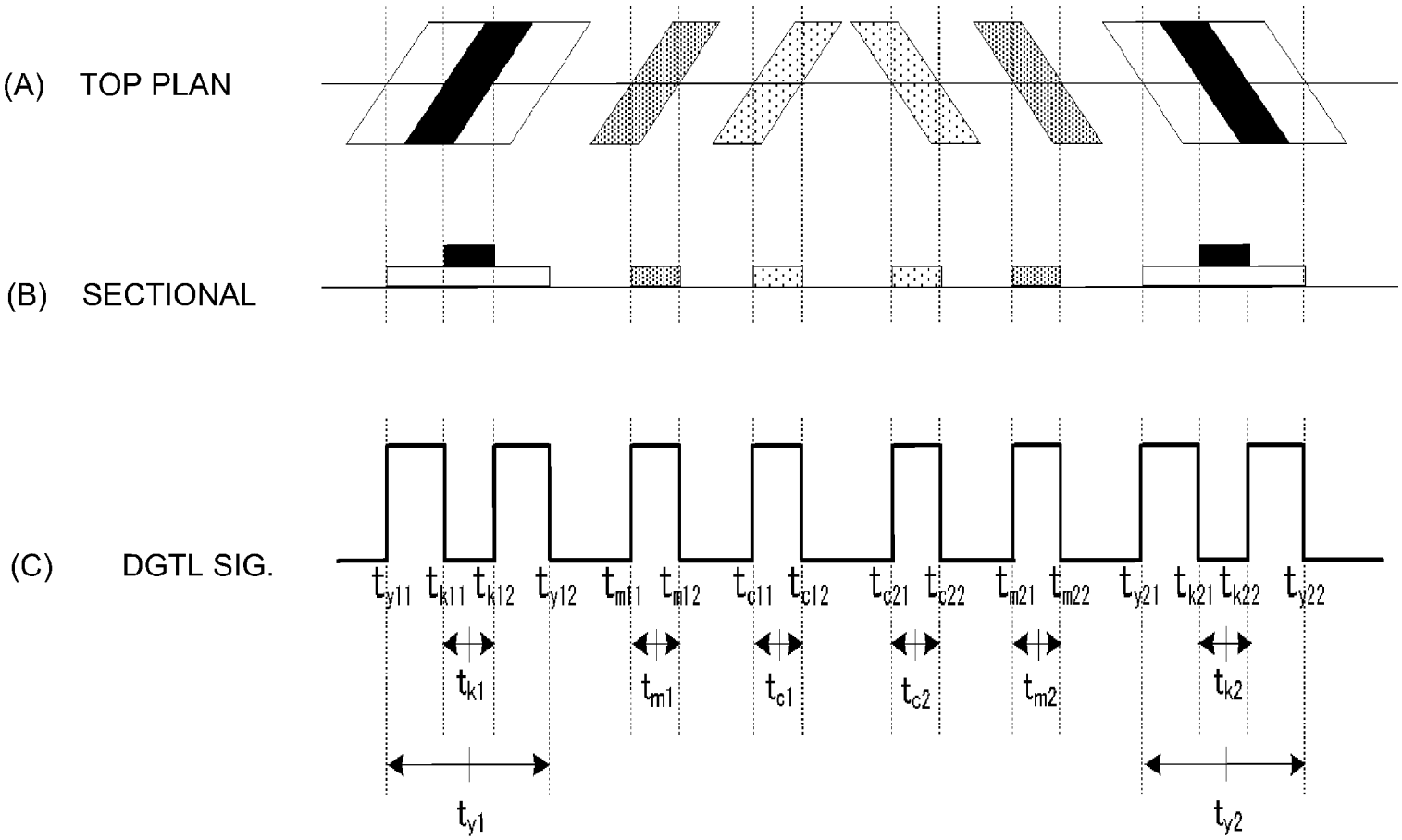
FIG. 8 also is a drawing which shows the pattern in which the positional deviation detection images are arranged, and the signals outputted by the sensor for detecting the trailing edge of each of the positional deviation detection images, in the first and second embodiments.

In this embodiment, the amount by which positional deviation will possibly occur among the images, different in color, for forming a multicolor image when the images are transferred onto the intermediary transfer belt 219 is obtained by computing the amount of positional deviation among the referential positional deviation detection image having the referential color, and each of the positional deviation detection images, which is different in color from the referential image. In the case of this embodiment, the amount of positional deviation of the magenta, cyan, and black images for positional deviation detection, relative to the yellow image for positional deviation detection, is calculated. FIG. 8(C) shows the points in time which correspond to the front edge, center, and trailing edge of each positional deviation detection images, computationally obtained by the control section 206 based on the digital signal obtained through the conversion of the analog signal outputted by the sensor unit 225 when the positional deviation detection images shown in FIGS. 8(A) and 8(B) were detected by the sensor unit 225. What the referential codes in FIG. 8(C) stand for are as follows:

ty11, ty12 and ty1: positions of front edge, trailing edge, and center of first yellow developer image, respectively, tk11, tk12 and tk1: positions of front edge, trailing edge, and center of first black developer image, respectively, tm11, tm12 and tm1: positions of front edge, trailing edge, and center of first magenta developer image, respectively, tc11, tc12 and tc1: positions of front edge, trailing edge, and center of first cyan developer image, respectively, ty21, ty22 and ty2: positions of front edge, trailing edge, and center of second yellow developer image, respectively, tk21, tk22 and tk2: positions of front edge, trailing edge, and center of second black developer image, respectively, tm21, tm22 and tm2: positions of front edge, trailing edge, and center of second magenta developer image, respectively, tc21, tc22 and tc2: positions of front edge, trailing edge, and center of second cyan developer image, respectively.

The position of the center of each positional deviation detection image can be obtained by following mathematical equations:

$$tk1=(tk11+tk12)/2$$

$$ty1=(ty11+ty12)/2$$

$$tm1=(tm11+tm12)/2$$

$$tc1=(tc11+tc12)/2$$

$$tk2=(tk21+tk22)/2$$

$$ty2=(ty21+ty22)/2$$

$$tm2=(tm21+tm22)/2$$

$$tc2=(tc21+tc22)/2$$

The difference in the length of time between the yellow developer image, or the referential developer image, and each of the rest of the developer images which are different in color, can be calculated with the use of the following mathematical equations, based on the calculated position of the center of each positional deviation detection image:

Amount of difference, in terms of length of time, of the black developer image: PDt_ky=((tk1−ty1)+(tk2−ty2))/2, Amount of difference, in terms of length of time, of the magenta developer image: PDt_my=((tm1−ty1)+(tm2−ty2))/2, and Amount of difference, in terms of length of time, of the cyan developer image: PDt_cy=((tc1−ty1)+(tc2−ty2))/2.

The point in time which corresponds to the positions of the front edge, trailing edge, and center of each positional deviation detection image corresponds to the elapsed length of time from a preset referential point in time (for example, point in time at which timer is started). The control section 206 calculates the amount of positional deviation of each of the positional deviation detection images other than the yellow positional deviation detection image, or the referential image, relative to the yellow positional deviation detection image, with the use of the following equations, based on the speed PS of the intermediary transfer belt 219 and the calculated amount, in length in time, of the positional deviation:

Amount of positional deviation of black developer image in terms of the secondary scan direction: Photosensitive drum1_ky=PS×PDt_ky, Amount of positional deviation of magenta developer image in terms of the secondary scan direction: Photosensitive drum1_my=PS×PDt_my, and Amount of positional deviation of cyan developer image in terms of the secondary scan direction: Photosensitive drum1_my=PS×PDt_cy.

The control section 206 carries out the above described computation for each positional deviation detection image set, and obtains the average amount of positional deviation of all the sets, obtaining thereby the amount of positional difference between the point in time at which each of positional deviation detection images other than the yellow positional deviation detection image, that is, the referential positional deviation detection image, begins to be formed (written) and the point in time at which the yellow positional deviation detection image begins to be formed (written). Here, the calculated amounts PDd1_ky, PDd1_my and PDd1_cy will be referred to as the first amount of positional deviation. If the first positional deviation is positive in value, it means that the point in time at which the black, magenta, and/or cyan positional deviation detection image began to be written is later relative to the point in time at which the yellow positional deviation detection image, or the referential positional deviation detection image, began to be written. On the other hand, if the first position deviation is negative in value, it means that the point in time at which the black, magenta, and/or cyan positional deviation detection image began to be written is earlier than the point in time at which the yellow positional deviation detection image, or the referential positional deviation detection image, began to be written.

[Errors Attributable to Trail Edge Piling]

In a case where the "trailing edge piling", that is, the phenomenon which results in increase in the image density of the downstream edge portion of a toner image, in terms of the secondary scan direction, formed on the intermediary transfer belt 219, did not occur, the waveform of the analog signal outputted by the sensor unit 225 is as indicated by a broken line in FIG. 7(C). In comparison, when the "trailing edge piling" occurred, the analog signal is as indicated by a solid line in FIG. 7(D). That is, it is later in terms of the point in time at which its steps down in potential for the following reason. That is, as the "trailing edge piling" occurs to the positional deviation detection images, the positional deviation detection images become higher in density across their trailing edge portion, which in turn increase the amount by which the light emitted by the light emitting element 303 and diffusely reflected by the positional deviation detection image is detected by the sensor unit 225.

In such a case, as shown in FIG. 7(D), the position of the trailing edge of the positional deviation detection image, which is determined based on the signal outputted by the sensor unit 225, is offset downstream compared to the detected position (actual position) of the trailing edge of the positional deviation detection image to which the "trail edge piling" did not occur. In FIG. 7(D), the difference in length of time which occurs between the actual and calculated positions of the trailing edge of each positional deviation detection image is shown by a referential code Δty, Δtm or Δtc. Because of this error in the detection of the position of the trailing edge of a positional deviation detection image, the position of the center of each positional deviation detection image, which is calculated based on the output signal of the sensor unit 225, is offset downstream by an amount proportional to the amount of increase, in density, of the trailing edge portion of the positional deviation detection image, which is attributable to the "trailing edge piling".

As described above, the position of the trailing edge of each positional deviation detection image, which is determined by calculation based on the output signal from the sensor unit 225, includes the error attributable to the "trailing edge piling". That is, the greater the amount of "trailing edge piling", the greater the error in the calculated position of the trailing edge of the positional deviation detection image, which is determined by calculation based on the output signal from the sensor unit 225, and therefore, the greater the error in the position of the center of the positional deviation detection image, which is calculated based on the calculated position of the trailing edge of the positional deviation detection image. Therefore, in order to accurately control the image forming apparatus 201 to correct the apparatus 201 in the positional deviation among multiple developer (toner) images which are different in color, it is necessary to take into consideration the deviation of the calculated position of the center of each positional deviation detection image from the actual center of each positional deviation detection image, which is attributable to the "trailing edge piling".

One of the thinkable solutions to this problem is to use the value obtainable by subtracting the amount of error in the position of the trailing edge of the positional deviation detection image, which is attributable to the "trailing edge piling", from the value which indicates the position of the trailing edge of the positional deviation detection image, which is determined by calculation based on the output signal from the sensor unit 225. In this case, the position of the center of each of the positional deviation detection images is obtained based on the corrected position of the tail end edge of the positional deviation detection image. Then, the amount of positional deviation among the positional deviation detection images which are different in color are obtained by comparing the positional deviation detection images in terms of the position of their center. Then, the image forming apparatus 201 is corrected in the positional deviation which occurs as multiple color developer images are sequentially transferred onto its intermediary transfer belt 219. Therefore, even if the "trailing edge piling" occurs, it is possible to accurately and precisely correct the image forming apparatus 201 in the positional deviation among multiple monochromatic developer images, different in color, which are formed to yield a multicolor image.

[Effect of Environment and Color upon Amount of "Trailing Edge Filing"]

The amount of "trailing edge piling" is affected by the changes in the temperature/humidity of the environment in which the image forming apparatus 201 is being used. Thus, the error in the detected amount of positional deviation among the positional deviation detection images reflects the changes in the temperature/humidity of the environment in which the image forming apparatus 201 is being used. More specifically, in an environment which is low in temperature/humidity, the triboelectric charge given to developer is narrow in its range of potential, and therefore, the amount of "trailing edge piling" is small. Therefore, the detected positional deviation among the positional deviation detection images is small in the amount of error. In comparison, as the environment in which the image forming apparatus 201 is being operated increases in temperature/humidity, the triboelectric charge which the developer acquires widens in the range of its potential, which in turn increases the amount of the "trailing edge piling". Therefore, the calculated amount of the positional deviation among the positional deviation detection images is more erroneous than when the environment in which the image forming apparatus 201 is being operated is low in temperature/humidity.

In this embodiment, therefore, the amount of error in the calculated position of the center of each positional deviation detection image, which is attributable to the "trailing edge piling" is estimated based on the ambient temperature/humidity of the image forming apparatus 201. Then, this estimated error is taken into consideration when the amount of positional deviation of each positional deviation detection image, relative to the referential positional deviation detection image, in terms of the direction of the secondary scan, which is calculated based on the output signal from the sensor unit 225, is corrected. The thus obtained amount of positional deviation will be referred to as "second amount of positional deviation", hereafter. Then, the image forming apparatus 201 is corrected in the positional deviation, based on the second amount of positional deviation. Thus, even if the "trailing edge piling" occurs to the positional deviation detection images, that is, even if developer piles along the trailing edge of the positional deviation detection image while the positional deviation detection image is formed, the error attributable to the "trailing edge piling" is minimized in its effect upon the calculation of the position of the trailing edge of the positional deviation detection image. Therefore, the image forming apparatus 201 can be accurately corrected in the positional deviation among the multiple color images, different in color, which are formed to yield a multicolor image.

Figure 9:
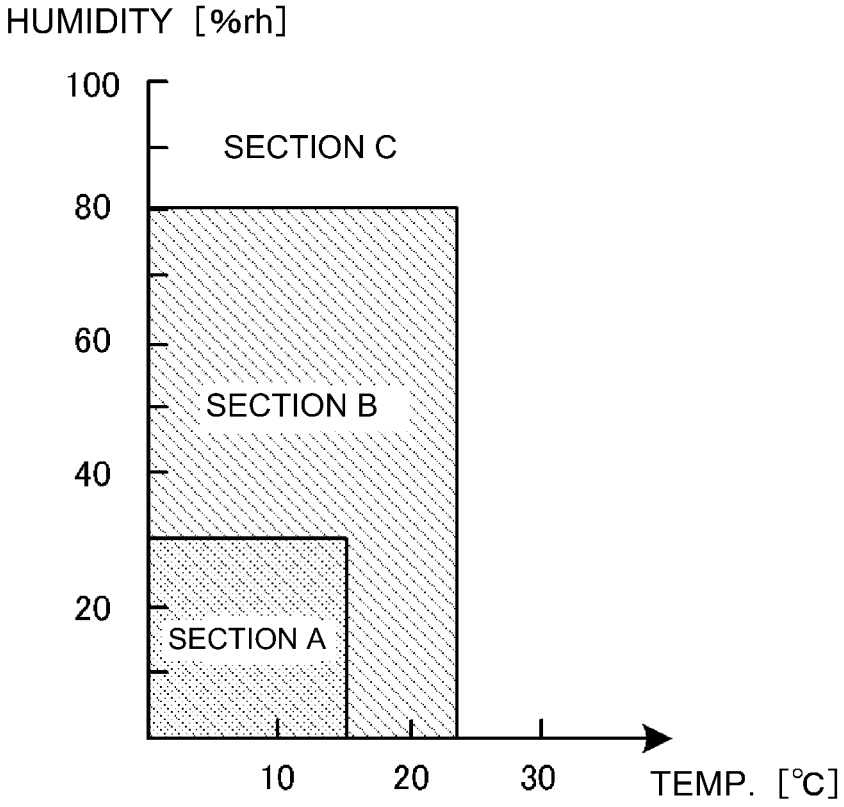
FIG. 9 is a graph which shows how the ambient temperature and humidity ranges of the image forming apparatus are divided in the first embodiment.

Next, the method for estimating the amount of the error attributable to the effect of the ambient temperature/humidity of the image forming apparatus 201 upon the amount of the "trailing edge piling", is described. Referring to FIG. 9, in this embodiment, each of the temperature range and humidity range is divided into three sub-ranges (Sub-ranges A-C). The amount by which developer piles up along the trailing edge of the positional deviation detection image while the positional deviation detection image is formed is affected by the color of the positional deviation detection image. In this embodiment, therefore, the position of the trailing edge of each positional deviation detection image is calculated based on the output signal from the sensor unit 225, under each sub-range of the temperature/humidity range, and the amount of the error in the calculated position of the positional deviation detection image, which is attributable to the "trailing edge piling" is found out in advance. Then, this information about the error is organized into a table which shows the relationship between the ambient temperature/humidity range (three sub-ranges) and developer color, and is stored in advance in a storage means 230. This information about the error is such information that shows the correlation between the environment in which the image forming apparatus 201 is being operated, and the error, and is used as the amount by which the first amount of positional deviation is corrected (amount for compensating for "trailing edge piling").

FIG. 1 is an example of a table which shows the relationship between the temperature/humidity range (having three sub-ranges), and the amounts PDe_ky, PDe_my and PDe_cy, by which the position of the trailing edge of the positional deviation detection image of black, magenta, and cyan colors, respectively, are to be corrected. In this embodiment, the temperature/humidity range is divided into three sub-ranges. However, it may be divided into four or more smaller sub-ranges. Further, instead of a table such as the one in FIG. 1, a formula for calculating the amount by which compensation is to be made for the "trailing edge piling" based on the temperature/humidity detected by the environment sensor 227 may be provided. Further, FIG. 1 is for the case in which the calculated position of each of the positional deviation detection images of black, magenta, and cyan colors, relative to the calculated position of the positional deviation detection image of yellow color, that is, the referential positional deviation detection image, is corrected. However, it is not mandatory that the color of the referential positional deviation detection image is yellow. That is, in a case where color other than yellow is chosen as the color for the referential positional deviation detection image, the table in FIG. 1 is to be modified so that it shows the relationship between the temperature/humidity range (three sub-ranges) and the amount by which the calculated position of the trailing edge of each of the positional deviation detection images, which is different in color from the referential positional deviation detection image, in terms of the amount by which the calculated position of each positional deviation detection image is corrected.

The control section 206 uses the amount of the positional deviation among multiple (four) developer (toner) images, different in color, which is determined based on the output signal from the sensor unit 225, and the amount of the "trailing edge piling", which is affected by the ambient temperature/humidity detected by the environment sensor 227. More specifically, the control section 206 adjusts the image forming apparatus 201 in the timing with which each developer (toner) image is formed by the image forming means.

[Control Sequence for Correcting Image Forming Apparatus in Positional Deviation among Multiple Developer Images]

Figure 10:
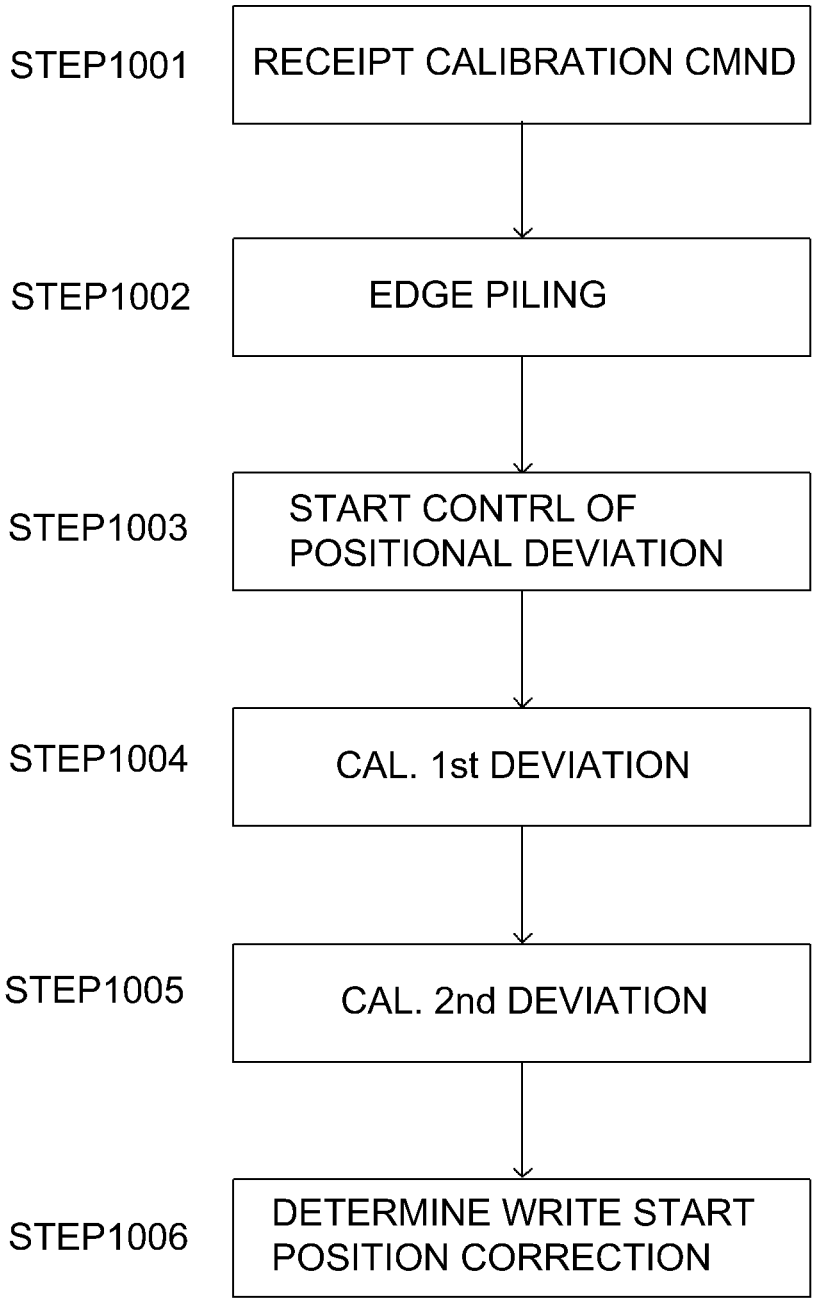
FIG. 10 is a flowchart of the control sequence for correcting the image forming apparatus in the positional deviation among monochromatic images, in the first and second embodiments.

FIG. 10 is a flowchart of the control sequence for correcting the image forming apparatus 201 in the positional deviation among multiple monochromatic developer images which the image forming apparatus 201 forms to yield a multicolor image. Hereafter, this control sequence will be referred to simply as "positional deviation control sequence". In Step 1001, the printable image data generation section 204 receives a calibration command, which is a command for making the image forming apparatus 201 carry out the positional deviation control sequence. As the section 204 receives the calibration command, the control section 206 obtains the values of the ambient temperature/humidity detected by the environment sensor 227.

In Step 1002, the control section 206 obtains, from the table for compensating for the "trailing edge piling", the amount by which the calculated position of the trailing edge of each positional deviation detection image is to be corrected according to the temperature/humidity detected by the environment sensor 227.

In Step 1003, the control section 206 determines (calculates) the amount of the positional deviation. More specifically, it makes the image forming apparatus 201 form positional deviation detection images on the intermediary transfer belt 219, obtains the output signal of the sensor unit 225, and calculates the front edge position, trailing edge position, and center position of each positional deviation detection image, based on the output signal of the sensor unit 225.

In Step 1004, the control section 206 calculates the first amounts PDd1_ky, PDd1_my and PDd1_cy of positional deviation, from the position of the center of each positional deviation detection image, calculated based on the output signal of the sensor unit 225.

In Step 1005, the control section 206 calculates the amounts PDe_ky, PDe_my and PDe_cy, by which the position of the trailing edge of the positional deviation detection image of black, magenta, and cyan colors, respectively, are to be corrected according to the ambient temperature/humidity detected by the environment sensor 227, with reference to the compensation table for the "trailing edge piling". Then, the control section 206 calculates the second amounts PDd2_ky, PDd2_km and PDd2_kc of positional deviation, from the calculated amount of compensation for the "trailing edge piling", and the first amounts of positional deviation, using the following mathematical equations:

$$PDd2_ky=PDd1+ky-PDe_ky,$$

$$PDd2_my=PDd1+my-PDe_my,$$

$$PDd2_cy=PDd1+cy-PDe_cy.$$

In Step 1006, the control section 206 transmits the second amounts of positional deviation to the printable image generation section 204, and makes the section 204 adjust, in proportion to the second amounts of the positional deviation, the position, in terms of the secondary scan direction, at which multiple images, different in color, begin to be written. Then, the control section 206 controls the image formation stations so that they begin to write multiple images, different in color, one for one, with the timings which correspond to the second amount of positional deviation. This correctional control sequence is only one of many correctional control sequences available for correcting the image forming apparatus 201, more specifically, the image forming stations (image forming means), in the position of the developer images formed on the image bearing members, one for one, by the image forming means, based on the second amount of positional deviation, in order to ensure that the registration of the monochromatic color toner images, different in color, formed on the photosensitive drums 215, one for one, will be such that the monochromatic color toner images properly align on the intermediary transfer belt 219, or the medium, onto which the monochromatic toner images are transferred in layers. As for the other correctional control sequences, there are a method which electrically corrects image formation signals, a method which drives the mirror, which is positioned in the laser beam path, in order to compensate for the error in the length and/or angle of the laser beam path for each color, which is attributable to the mechanical error, such as the error in the distance among the photosensitive drums, which is attributable to the attachment of the photosensitive drums, and the like methods. In the case of such methods, the control section 206 corrects the image formation signal, based on the table stored in the ROM of the control section 206, in order to correct the image forming apparatus 201 in terms of the error in the registration (positional deviation) of each monochromatic color image on the photosensitive drum.

In this embodiment, the position of the trailing edge of each positional deviation detection image, which is calculated based on the output signal from the sensor unit 225, is corrected in consideration of the error attributable to the "trailing edge piling". Then, the image forming apparatus 201 is corrected in the image formation operation, based on the corrected position of the trailing edge of the positional deviation detection image, so that the apparatus 201 is minimized in the amount of positional deviation among multiple monochromatic image, different in color, which are formed to yield a multicolor image. That is, the information related to the amount by which compensation is to be made for the error in the position of the trailing edge of the positional deviation detection image, which is determined based on the output signal of the sensor unit 225, that is, the distance between the position of the trailing edge of the positional deviation detection image, which is determined based on the output signal of the sensor unit 225 and the actual position of the trailing edge of the positional deviation detection image, which is attributable to the unintended increase in image density which occurs to the downstream edge portion of the positional deviation detection image, in terms of the direction in which recording medium is conveyed or the intermediary transfer belt 219 is moved, when a monochromatic developer image is transferred onto a sheet of recording medium or the intermediary transfer belt 219, is stored in advance for each color. Then, the image forming apparatus 201 is corrected in the position in which the developer image is formed by the image forming means, based on the information about the position of each of multiple positional deviation detection images, different in color, formed on a sheet of recording medium or the intermediary transfer belt 219, and the information about the amount by which the position of the positional deviation detection image is to be corrected, in order to minimize the image forming apparatus 201 in terms of the positional deviation among the multiple monochromatic developer images, different in color, which are formed to yield a multicolor image. Further, the effect of the temperature/humidity (environmental factors) of the environment in which the image forming apparatus 201 is being operated, upon the amount of the "trailing edge piling" is taken into consideration. Therefore, even if the "trailing edge piling" occurs, that is, even if developer particles pile along the trailing edge of the exposed portion of the peripheral surface of the photosensitive drum 215, the image forming apparatus 201 is highly precisely corrected in the positional deviation among the multiple monochromatic developer images formed to yield a multicolor image.

In this embodiment, first, the amount (first amount) of positional deviation of each positional deviation detection image, relative to the referential positional deviation detection image (positional deviation detection image of yellow color in this embodiment), in terms of the secondary scan direction, is calculated, and then, the first amount of positional deviation is adjusted based on the information about the error which is attributable to the "trailing edge piling" and may be in the calculated position of the trailing edge of the positional deviation detection image. However, the method for compensating for the error in the position of the trailing edge of the positional deviation detection image, which is attributable to the "trailing edge piling", based on the information about the amount by which the first amount of positional deviation is to be corrected, is not limited to the above described one. For example, the amount of the positional deviation, which does not include the error attributable to the "trailing edge piling", may be calculated by correcting the amount of the positional deviation of the trailing edge of the positional deviation detection image, which is calculated from the output signal from the sensor unit 225, using the information about the amount by which the correction is to be made. Further, it may be calculated by correcting the position of the trailing edge of the positional deviation detection image calculated from the output signal from the sensor unit 225, based on the information about the amount by which the correction is to be made, and then, calculating the amount of positional deviation, from the corrected position of the trailing edge of the positional deviation detection image. The values in FIG. 1 which are for the amount by which the trailing edge position of the positional deviation detection image calculated from the output signal from the sensor unit 225 is to be adjusted, have only to be set and stored in advance, according to what kind of factor is to be adjusted in value.

(Embodiment 2)

Next, the second embodiment of the present invention is described. The basic structure of the sensor unit, and the basic design and arrangement of the positional deviation detection images, in this embodiment are the same as those in the first embodiment. Therefore, they are not going to be described in detail here.

The environment sensor 227 positioned in the image forming apparatus 201 in this embodiment is a temperature detection element such as a thermistor. More specifically, the environment sensor 227 is placed with the image forming apparatus 201, in the area which is unlikely to be affected by the heat generated within the image forming apparatus 201, and yet, in which the environment sensor 227 can accurately detect the ambient temperature of the image forming apparatus 201. The environment sensor 227 detects the ambient temperature of the image forming apparatus 201. In this embodiment, the environment sensor 227 is positioned inside the image forming apparatus 201, in the area in which the environment sensor 227 can accurately detect the ambient temperature of the image forming apparatus 201. However, it is not mandatory that the environment sensor 227 is placed in the above described location. That is, the position in which the environment sensor 227 is to be placed may be any location as long as the location allows the environment sensor 227 to accurately detect the ambient temperature of the image forming apparatus 201.

Figures 11, 12:
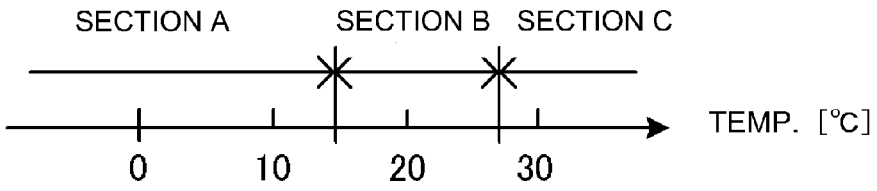
FIG. 11 is a graph which shows the division of the temperature range of the environment in which the image forming apparatus is operated, in the second embodiment.
FIG. 12 is an example of a table which shows the relationship between the temperature/humidity range (having three sub-ranges), and the amounts PDet_ky, PDet_my and PDet_cy, by which the position of the trailing edge of the positional deviation detection images of black, magenta, and cyan colors, respectively, are to be corrected.

The amount by which the error attributable to the "trailing edge piling" is to be corrected is set based on the temperature level detected by the environment sensor 227. Referring to FIG. 11, the range into which the temperature detected by the environment sensor 227 is expected to fall is divided into three sub-ranges A-C, and the amount by which the error attributable to the "trailing edge piling" is set in advance for each sub-range. Further, since the amount of the "trailing edge piling", that is, the amount by which developer piles along the trailing edge of an exposed area of the peripheral surface of the photosensitive drum 215 is affected by the color of the image to be formed on the photosensitive drum 215. Therefore, the amount by which the error attributable to the "trailing edge piling" is to be corrected is set in advance for each color for the positional deviation detection image. FIG. 12 is an example of a table which shows the relationship in terms of the amounts PDet_ky, PDet_my and PDet_cy by which the error attributable to the "trailing edge piling" is to be corrected, with respect to the temperature (three sub-ranges) detected by the see 227 and the colors of the positional deviation detection images. In this embodiment, the temperature range is divided into three sub-ranges. However, the temperature range may be divided into four or more narrower sub-ranges. Further, instead of relying on a table such as the one in FIG. 12, a formula for computing the amount by which compensation is made for the error attributable to the "trailing edge piling", based on the ambient temperature of the image forming apparatus 201 may be created so that the error attributable to the "trailing edge piling" can be calculated based on the ambient temperature of the image forming apparatus 201. That is, the information about the error attributable to the "trailing edge piling" to be stored in the storage means 230 may be a table like the one in FIG. 1, or a formula usable to compute the amount of error attributable to the "trailing edge piling", based on the ambient temperature of the image forming apparatus 201 and/or the color of the developer. The control section control section 206 obtains the amount by which the error attributable to the trailing edge piling to be corrected, with reference to the table or formula stored in the storage means 230.

The operational sequence for correcting the image forming apparatus in the positional deviation among the multiple developer images, different in color, which are formed to yield a multicolor image is the same as the one in the first embodiment. That is, it is the same as Steps 1001-1006. In this embodiment, the second amounts PDd2_ky, PDd2_my and PDd2_cy of the positional deviation are calculated with the use of the following equations:

$$PDd2_ky=PDd1_ky+PDet_ky,$$

$$PDd2_my=PDd1_my+PDet_my,$$

$$PDd2_cy=PDd1_cy+PDet_cy.$$

Figure 13:
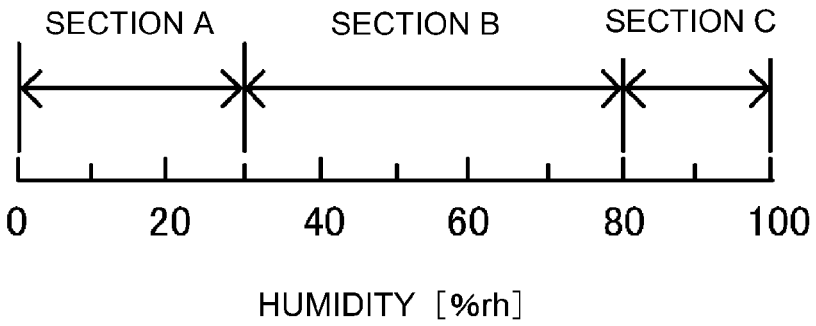
FIG. 13 is a drawing which shows the division of the humidity range of the environment in which the image forming apparatus is operated, in the second embodiment.
Figure 14:
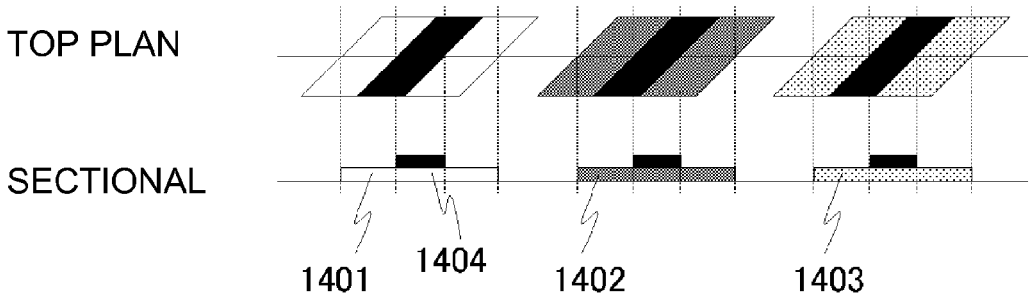
FIG. 14 is a drawing which shows the positional deviation detection images in accordance with the background art, and the pattern in which the images are arranged.
Figure 15:
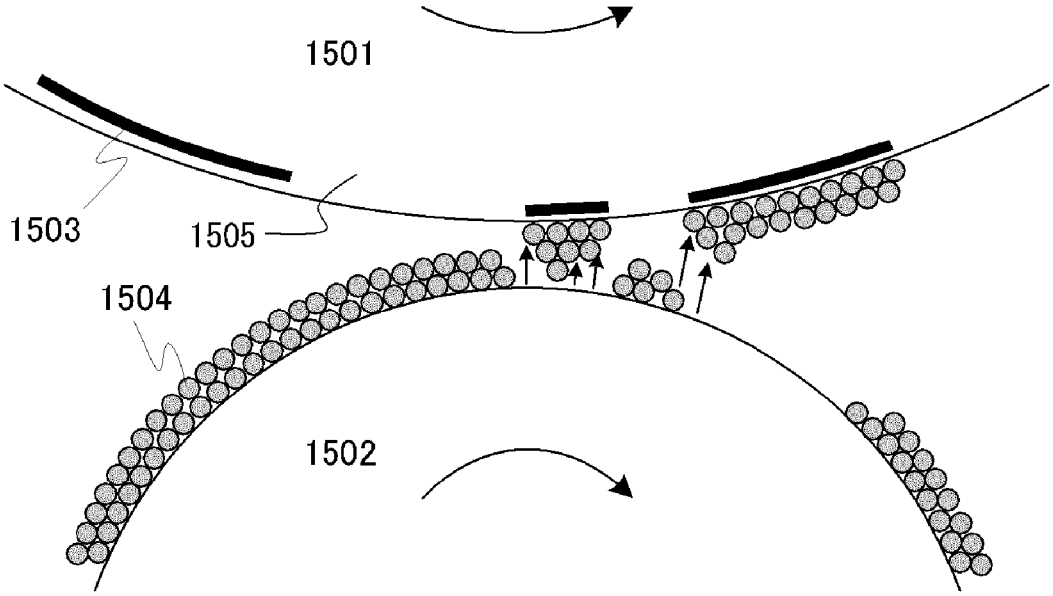
FIG. 15 is a drawing for describing the principle based on which the "trailing edge piling" occur.
Figure 16:
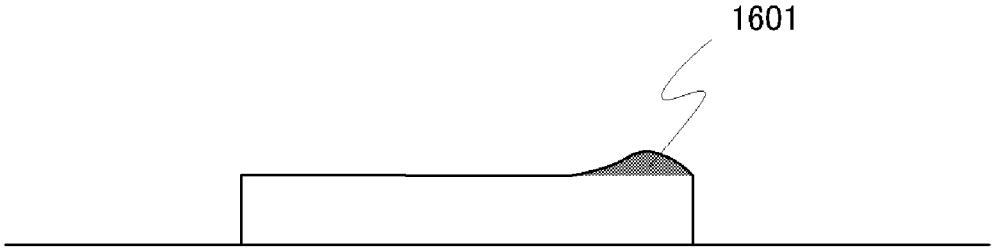
FIG. 16 is a drawing for showing the piling of developer (toner) along the trailing edge of the exposed area of the peripheral surface of the photosensitive drum.
Figure 17:
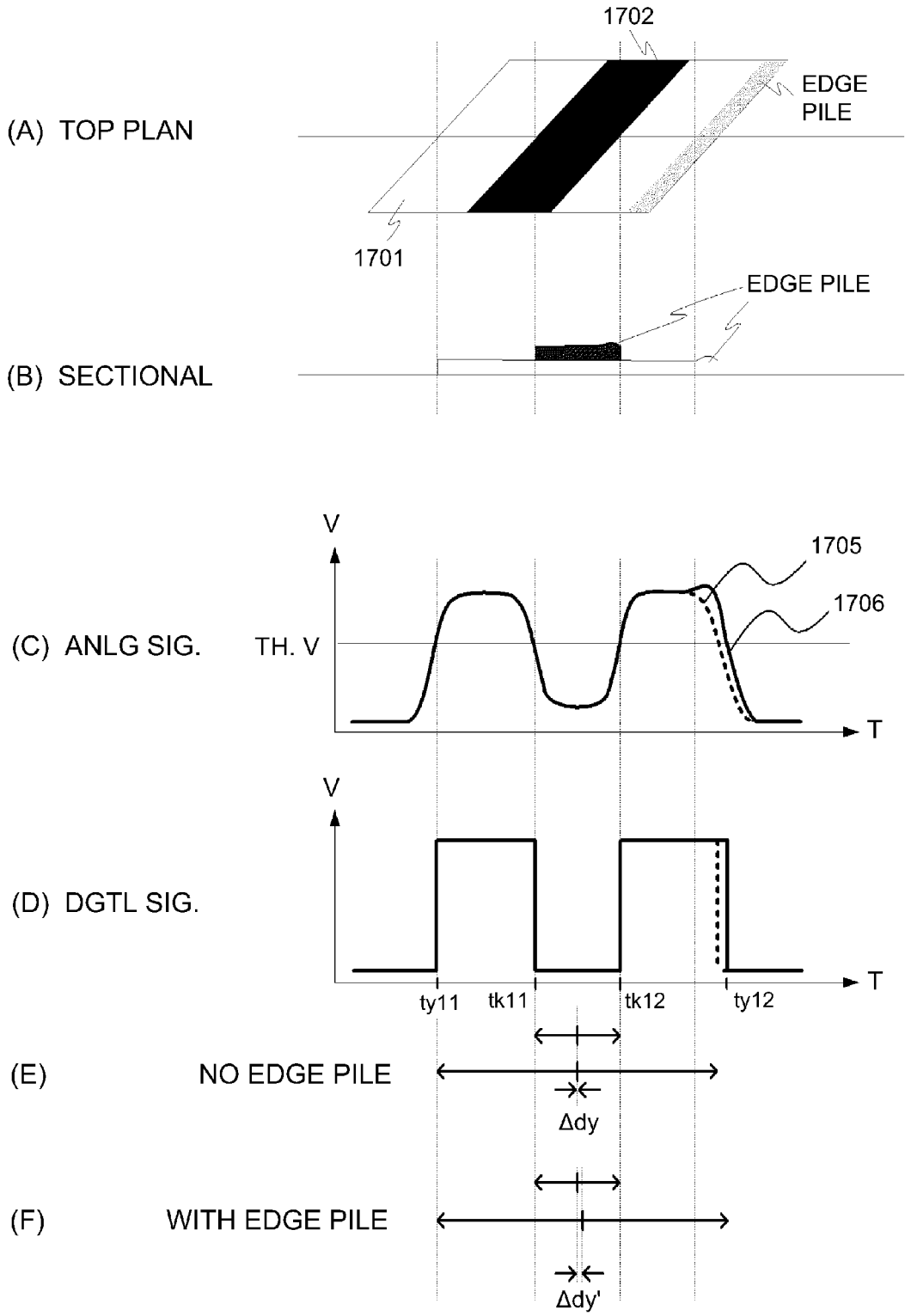
FIG. 17 is a drawing of the positional deviation detection image in accordance with the prior art, and the waveform of the signal outputted by the sensor for detecting the amount by which light is reflected by the surface of the positional deviation detection image.

In this embodiment, the environment sensor 227 is a temperature detection element. However, it may be a humidity detection sensor. In a case where it is a humidity detection sensor, the humidity range is divided into three sub-ranges A-C, as shown in FIG. 13, and a table such as the one in FIG. 12 which shows the relationship between the humidity range (having three sub-ranges), and the amounts by which the position of the trailing edge of the positional deviation detection image of black, magenta, and cyan colors, respectively, are to be adjusted, is stored in the storage means 230. Then, the amount by which the position of the trailing edge of the positional deviation detection image, which is calculated based on the output signal from the sensor unit 225, is to be corrected in terms of the error attributable to the "trailing edge piling" is calculated based on the detected humidity, with reference to the table in the storage means 230. In other words, the second amount of positional deviation may be calculated from the first amount of positional deviation and the amount by which the position of the trailing edge of the positional deviation detection image calculated from the output signal of the sensor unit 225 is to be adjusted in terms of the error attributable to the "trailing edge piling", as in the first embodiment.

The control section 206 makes the image formation stations start writing images, different in color, one for one, with the timings based on the second amount of positional deviation.

In this embodiment, the image forming apparatus 201 is more simply structured than the one in the first embodiment. That is, the condition of the environment in which the image forming apparatus 201 is being used is detected by using only the temperature sensor or humidity sensor, and the amount by which the trailing edge position of each positional deviation detection image detected by the sensor unit 225 is to be corrected in terms of the error attributable to the "trailing edge piling" is calculated based on the ambient humidity detected by the humidity sensor. Then, the point at which each of multiple developer images, different in color, is to begin to be written is adjusted by the calculated amount by which the trailing edge position of each positional deviation detection image detected by the sensor unit 225 is to be corrected in terms of the error attributable to the "trailing edge piling". Therefore, even in a case where the "trailing edge piling" occurs, that is, developer piles along the trailing edge of an exposed portion of the peripheral surface of the photosensitive drum 215, the image forming apparatus 201 is highly precise in the position at which each of multiple developer images, different in color, is to begin to be written.

In the preceding embodiments, the amount (first amount) by which the position of the trailing edge of each positional deviation detection image, which is detected by the sensor unit 225 and includes the error attributable to the "trailing edge piling", is to be adjusted in consideration of the error attributable to the "trailing edge piling" to obtain the second amount by which the position at which each of the multiple images, different in color, is to begin to be written is adjusted. Then, based on the second amount of positional deviation, the image forming apparatus 201 is adjusted in the timing with which each of the multiple images, different in color, is to begin to be written (by laser). In the present invention, however, the timing with which the writing of the positional deviation detection image on the intermediary transfer belt 219 ends, that is, the timing with which the trailing edge of the positional deviation detection image is written on the intermediary transfer belt 219, may be advanced by the amount equivalent to the amount of error attributable to the "trailing edge piling". That is, the image forming apparatus 201 may be adjusted in the registration, in advance for the image forming means, by the amount equivalent to the error attributable to the "trailing edge piling", in order to make the timing with which the writing of the trailing edge of the positional deviation detection image is to be ended, earlier than the original timing set by the information about the image to be formed, by modifying the control program and/or table to be used to control the operation of the image forming means based on the information about the image to be formed.

As the image forming means is controlled as described above, the portion of the intermediary transfer belt 219, on which the trailing edge of the positional deviation detection image is to be formed, shifts frontward (upstream in terms of moving direction of intermediary transfer belt 219) of the original portion of the intermediary transfer belt 219, on which the trailing edge of the positional deviation detection image is to be formed. On the other hand, as described above, due to the error attributable to the "trailing edge piling", the position of the trailing edge of the positional deviation detection image calculated based on the output signal from the sensor unit 225 deviates rearward (downstream in terms of moving direction of intermediary transfer belt 219). Thus, if the timing with which the writing of each positional deviation detection image ends is advanced so that the frontward deviation and rearward deviation cancel each other, it is possible to make the trailing edge position of the positional deviation detection image calculated from the output signal from the sensor unit 225 precisely coincide with the point at which the trailing edge of the positional deviation detection image will be actually.

In this case, the amount (first amount) of positional deviation to be calculated based on the position of the trailing edge of the positional deviation detection image calculated based on the output signal from the sensor unit 225 will have been rid of the error attributable to the "trailing edge piling". Therefore, the image forming apparatus 201 is more precisely corrected in the amount of positional deviation among the multiple developer images, different in color, than in a case where it is corrected based on the first amount of the positional deviation in the preceding embodiments.

Further, in the preceding embodiments, the image forming apparatus 201 was structured so that developer images were transferred (primary transfer) from the photosensitive drums 215, as image bearing members, onto the intermediary transfer belt 219, as intermediary transfer medium, and then, the developer images on the intermediary transfer belt 219 are transferred (secondary transfer) onto a sheet of recording paper. However, the present invention is also applicable to an image forming apparatus equipped with a transferring means which directly transfers developer images onto a sheet of recording paper, as final recording medium, from the photosensitive drums 215. In a case where the present invention is applied to such an image forming apparatus, the sensor unit 225 detects the position of the trailing edge of positional deviation detection images formed on a sheet of recording paper.

Further, in each of the preceding embodiments, the photosensitive drums 215 were fixed in position, and the intermediary transfer belt 219 was circularly moved. Therefore, the developer images, different in color, are different in position at which they are transferred onto the intermediary transfer belt 219. However, the present invention is also applicable to an image forming apparatus structured so that its multiple photosensitive drums are sequentially moved into a single location in which they are transferred onto the intermediary transferring member (primary transferring member) or a sheet of recording medium (paper) (secondary transfer member).

While the invention has been described with reference to the structures disclosed herein, it is not confined to the details set forth, and this application is intended to cover such modifications or changes as may come within the purposes of the improvements or the scope of the following claims.

This application claims priority from Japanese Patent Application No. 270296/2011 filed Dec. 9, 2011 which is hereby incorporated by reference.

What is claimed is:

1. An image forming apparatus comprising:

an image forming unit for forming a correction image for correcting a positional deviation;

an image carrying member for receiving the correction image formed by said image forming unit;

a light detection unit for illuminating the correction image on said image carrying member and detecting light reflected thereby;

an ambient condition detection unit for detecting, as an ambient condition, at least one of a temperature and a humidity in said image forming apparatus;

a correction unit for correcting, on the basis of the ambient condition detected by said ambient condition detection unit, such an error in a detection result of said light detection unit as is attributable to an increase of image density caused at an end portion of the correction image; and a control unit for controlling, on the basis of a correction result provided by said correction unit, a position correction when said image forming unit forms an image.

2. The apparatus according to claim 1, further comprising a calculation unit for calculating a position of the correction image formed on said image carrying member on the basis of a correction result corrected by said correction unit, wherein said control unit carries out the position correction control at the time when said image forming unit forms the image, on the basis of a calculation result of said calculation unit.

3. The apparatus according to claim 1, further comprising a calculation unit for calculating the position of the correction image formed on said image carrying member, on the basis of the detection result of said light detection unit, wherein said correction unit corrects the calculation result of said calculation unit in accordance with the ambient condition detected by said ambient condition detection unit, and wherein said control units carries out the position correction control at the time when said image forming unit forms the image, on the basis of the correction result of said correction unit.

4. The apparatus according to claim 1, further comprising a calculation unit for calculating the position of the correction image formed on said image carrying member, on the basis of the detection result of said light detection unit; and a storing unit for storing information related to a correction amount for correcting a difference between an actual position and a position which is caused by an increase of an image density at a downstream end of the correction image with respect to a moving direction of said image carrying member and which is calculated by said calculation unit, wherein said correction unit corrects the calculation result of said calculation unit in accordance with the information stored in said storing unit, and wherein said control units carries out the position correction control at the time when said image forming unit forms the image, on the basis of the correction result of said correction unit.

5. The apparatus according to claim 4, wherein the correction image includes developer images of different colors, and wherein said storing unit stores information of a corresponding relation between the ambient condition and the correction amount as a table storing a value of the correction amount for each color of the developer and for each ambient condition, or stores information of the corresponding relation between the ambient condition and the correction amount as an operational expression for calculating a value of the correction amount in accordance with the ambient condition determined for each developer.

6. The apparatus according to claim 4, wherein the correction result increases with increase of the temperature or the humidity.

7. The apparatus according to claim 1, wherein the correction image includes developer images of different colors.

8. The apparatus according to claim 7, wherein the correction image includes overlaid developer images of different colors.

9. The apparatus according to claim 7, further comprising a calculation unit for calculating positions of the developer images on said image carrying member and calculating a deviation amount, relative to a position of the developer image of a predetermined reference color, of a position of the developer image of another color, on the basis of the detection result of the developer images detected by said light detection unit, wherein said correction unit corrects the calculation result of said calculation unit in accordance with the ambient condition detected by said ambient condition detection unit, and wherein said control unit carries out the position correction control at the time when said image forming unit forms the image, on the basis of the correction result of said correction unit.

10. The apparatus according to claim 7, wherein said correction unit corrects the detection result of the developer images of the different colors detected by said light detection unit, in accordance with the ambient condition detected by said ambient condition detection unit, wherein a calculation unit calculates positions of the developer images on said image carrying member and calculates a deviation amount, relative to a position of the developer image of a predetermined reference color, of a position of the developer image of another color, on the basis of a correction result of said correction unit, and wherein said control unit carries out the position correction control at the time when said image forming unit forms the image, on the basis of a calculation result of said calculation unit.

11. The apparatus according to claim 1, wherein said image carrying member is an intermediary transfer belt or a recording material feeding belt.

12. The apparatus according to claim 1, further comprising one or more image forming units, and said image forming units form the images with respective color developers.

13. An image forming apparatus comprising:

an image forming unit for forming a correction image for correcting a positional deviation;

an image carrying member for receiving the correction image formed by said image forming unit;

a light detection unit for illuminating the correction image on said image carrying member and detecting light reflected thereby; and a control unit for effecting position correction control at a time of image formation of said image forming unit on the basis of the detection result of said light detection unit and correction information for correcting such an error as is attributable to an increase of image density caused at an end portion of the correction image.

14. The apparatus according to claim 13, further comprising a correction unit for correcting the detection result of said light detection unit in accordance with the correction information; and a calculation unit for calculating a position of the correction image formed on said image carrying member on the basis of a correction result corrected by said correction unit, wherein said control unit effects the position correction control at the time when said image forming unit forms the image, on the basis of a calculation result of said calculation unit.

15. The apparatus according to claim 13, further comprising a calculation unit for calculating the position of the correction image formed on said image carrying member, on the basis of the detection result of said light detection unit; and a correction unit for correcting the calculation result of said calculation unit in accordance with the correction information, wherein said control unit effects the position correction control at the time when said image forming unit forms the image, on the basis of the correction result of said correction unit.

16. The apparatus according to claim 15, wherein the correction information is to correct a difference between an actual position of the correction image and a position which is caused by the increase of image density at a downstream end of the correction image with respect to a moving direction of said image carrying member and which is calculated by said calculation unit.

* * * * *

UNITED STATES PATENT AND TRADEMARK OFFICE

CERTIFICATE OF CORRECTION

PATENT NO. : 9,141,016 B2
APPLICATION NO. : 13/707912
DATED : September 22, 2015
INVENTOR(S) : Watanabe It is certified that error appears in the above-identified patent and that said Letters Patent is hereby corrected as shown below:

ON THE TITLE PAGE:

Please correct the Assignee name as follows:

Item (73) ASSIGNEE:

"Canon Kabushiki Kiasha" to -- Canon Kabushiki Kaisha --

Signed and Sealed this
Second Day of August, 2016

Michelle K. Lee

Michelle K. Lee
*Director of the United States Patent and Trademark Office*